US005925312A

United States Patent [19]

Lin et al.

[11] Patent Number: 5,925,312

[45] Date of Patent: Jul. 20, 1999

[54] PUSH-PULL APPARATUS ADAPTED FOR ASSEMBLING AND DISASSEMBLING A TUBULAR BODY THAT IS TO BE FITTED INTO A RING RETAINER ON A WALL MEMBER

[75] Inventors: Yu-Long Lin; Kuo-Tang Lin, both of Kaohsiung, Taiwan

[73] Assignee: China Steel Corporation, Kaohsiung, Taiwan

[21] Appl. No.: 09/098,746

[22] Filed: Jun. 17, 1998

[51] Int. Cl.[6] ..... C21B 7/16

[52] U.S. Cl. ..... 266/269; 266/287; 266/DIG. 1

[58] Field of Search ..... 266/269, 271, 266/272, 287, DIG. 1, 45

[56] References Cited

U.S. PATENT DOCUMENTS

| | | | |
|---|---|---|---|
| 4,087,084 | 5/1978 | Meyers | 266/287 |
| 5,127,633 | 7/1992 | Mailliet | 266/271 |
| 5,133,534 | 7/1992 | Gortan et al. | 266/271 |

FOREIGN PATENT DOCUMENTS 001444354 12/1988 Russian Federation .

*Primary Examiner*—Scott Kastler

*Attorney, Agent, or Firm*—Baker & Botts, L.L.P.

[57] ABSTRACT

A push-pull apparatus includes a machine base, and a coupling unit having a retractable main frame disposed on top of the machine base and longitudinally movable in forward and rearward directions relative to the machine base, and a coupler mounted on a front end of the main frame and adapted to be extended into a ring retainer on a wall member to engage a tubular body that is fitted into the ring retainer. An extension unit is mounted on the machine base and is connected to the coupling unit. The extension unit is operable so as to move the coupling unit relative to the machine base. An impact unit is provided on the coupling unit. A drive unit is mounted on the coupling unit and is operable so as to move the impact unit along the coupling unit in order to enable the impact unit to impact a selected one of the front and rear ends of the main frame and generate at the coupler one of a pushing force for assembling the tubular body and a pulling force for disassembling the tubular body.

6 Claims, 8 Drawing Sheets

PUSH-PULL APPARATUS ADAPTED FOR ASSEMBLING AND DISASSEMBLING A TUBULAR BODY THAT IS TO BE FITTED INTO A RING RETAINER ON A WALL MEMBER

BACKGROUND OF THE INVENTION

1. Field of the Invention

The invention relates to the assembly and disassembly of a tubular body, more particularly to a push-pull apparatus for assembling and disassembling a tubular body that is to be fitted into a ring retainer on a wall member.

2. Description of the Related Art

In a blast furnace, air must be supplied for making iron products. Thus, several tuyeres are installed near the bottom portion of the furnace for feeding air into the furnace. The tuyeres must be periodically removed from the furnace for maintenance and replacement.

Generally, the furnace has a wall member with a cooling ring retainer secured thereon. The tuyere is a tubular body that is fitted into the cooling ring, which is made of copper, such that the tuyere extends into the furnace. When assembling or disassembling the tuyere from the furnace, a bar of about four meters in length is extended into the cooling ring from the outside of the furnace, and up to twelve operators join forces to push or pull the tuyere toward or away from the cooling ring. Therefore, assembly and disassembly of the tuyere is currently conducted in a labor-intensive manner. In addition, because of the tight engagement between the cooling ring and the tuyere, injuries to operators can easily occur during disassembly of the tuyere. Moreover, because the tuyere is a relatively heavy component, it is inconvenient to move the tuyere during assembly or after disassembly.

SUMMARY OF THE INVENTION

Therefore, the object of the present invention is to provide a push-pull apparatus adapted for assembling and disassembling a tubular body that is to be fitted into a ring retainer on a wall member in a safe and cost-efficient manner.

Accordingly, the push-pull apparatus of this invention comprises:

a machine base;

a coupling unit including a retractable main frame disposed on top of the machine base and longitudinally movable in forward and rearward directions relative to the machine base, the main frame having front and rear ends, the coupling unit further including a coupler mounted on the front end of the main frame and adapted to be extended into the ring retainer to engage the tubular body;

an extension unit mounted on the machine base and connected to the coupling unit, the extension unit being operable so as to move the coupling unit relative to the machine base;

an impact unit provided on the coupling unit and movable along the coupling unit; and a drive unit mounted on the coupling unit and operable so as to move the impact unit along the coupling unit in order to enable the impact unit to impact a selected one of the front and rear ends of the main frame of the coupling unit and generate at the coupler of the coupling unit one of a pushing force for assembling the tubular body and a pulling force for disassembling the tubular body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
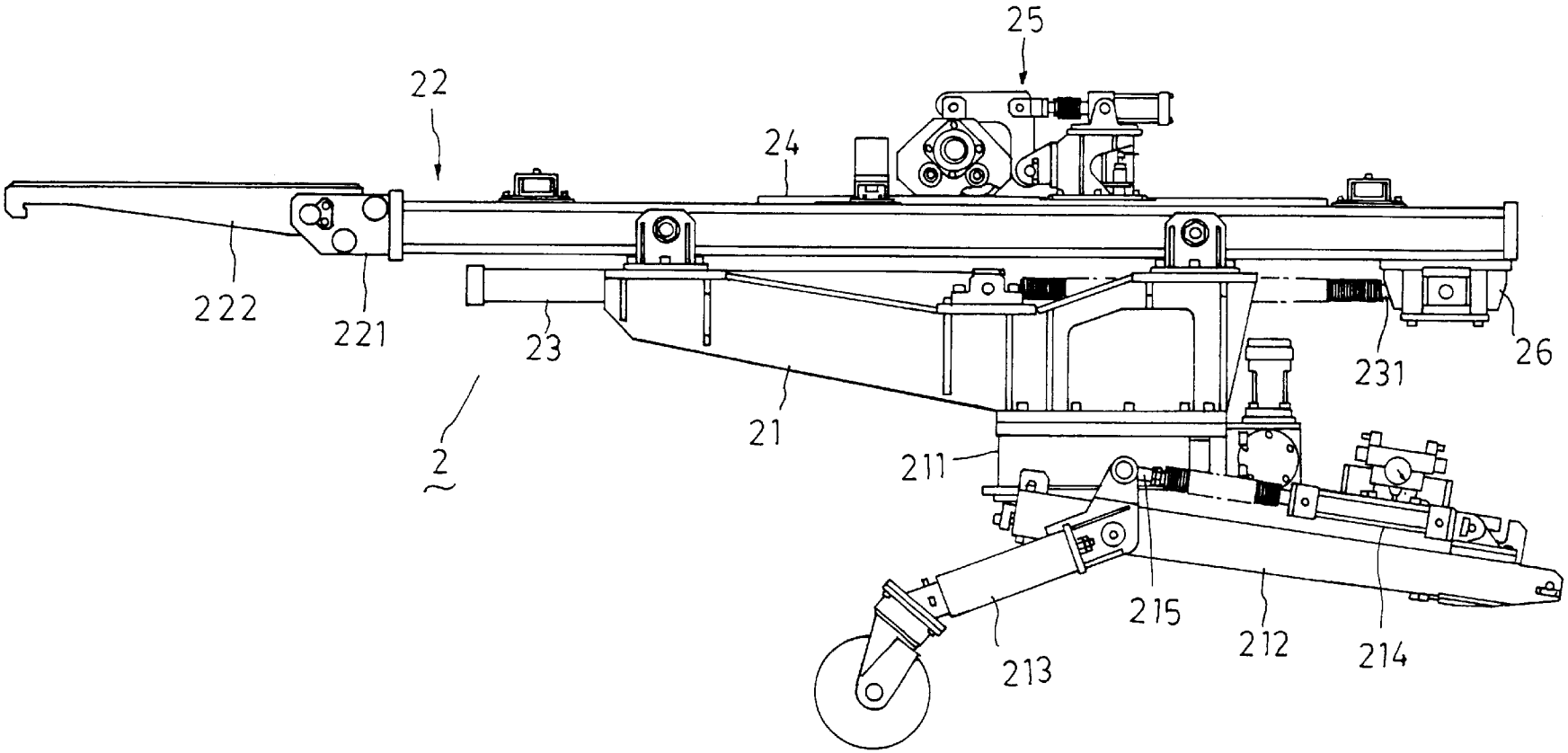
FIG. 1 is a schematic side view of the preferred embodiment of a push-pull apparatus according to the present invention.
Figure 2:
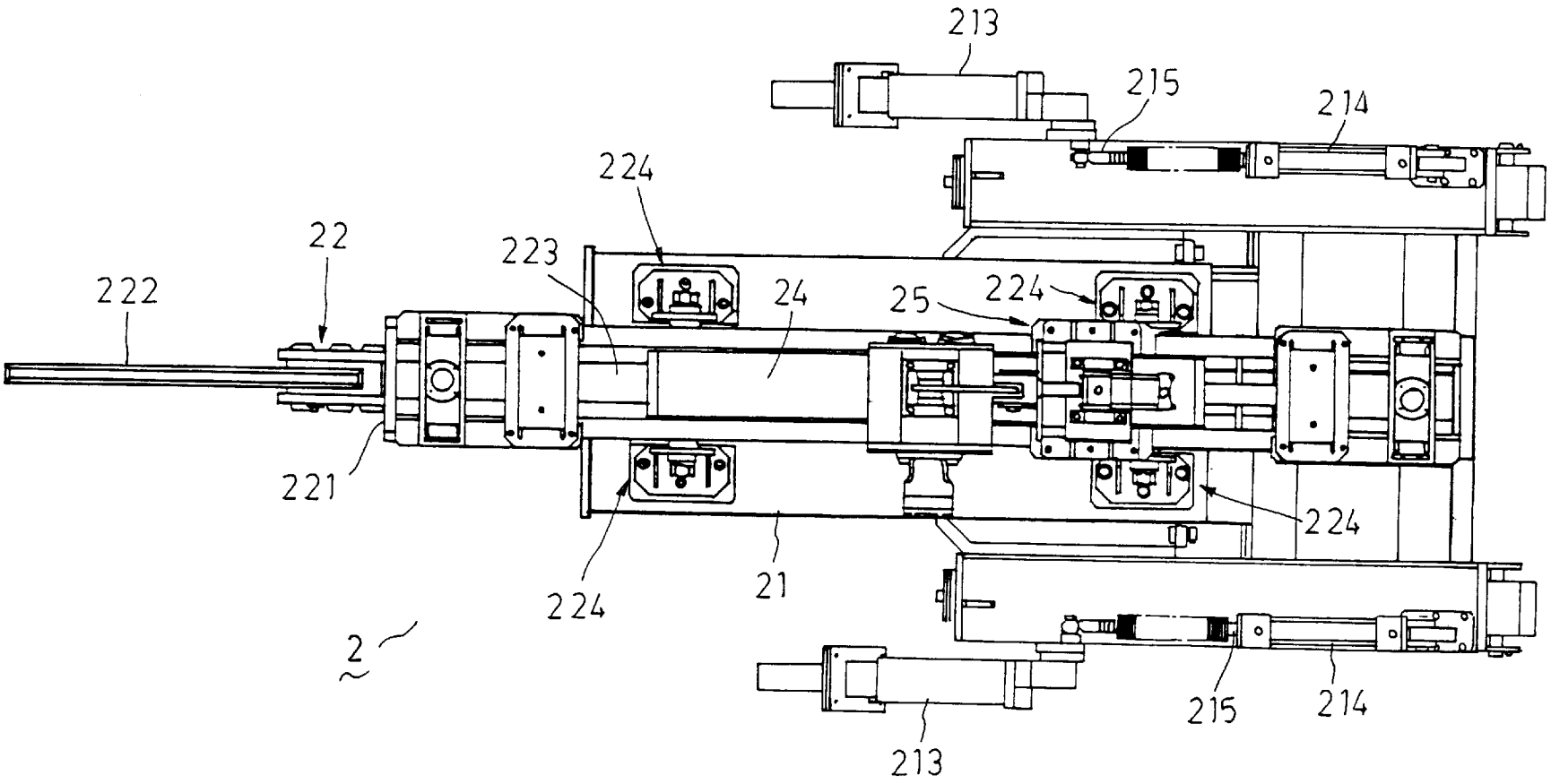
FIG. 2 is a schematic top view of the preferred embodiment.

Referring to FIGS. 1 and 2, the preferred embodiment of a push-pull apparatus 2 according to the present invention is shown to comprise a machine base 21, a coupling unit 22, an extension unit 23, an impact unit 24, and a drive unit 25.

A base frame 212 has front and rear end portions, and a rotary platform 211 mounts rotatably the machine base 21 on the base frame 212 such that the machine base 21 is rotatable about a vertical axis. A pair of wheel-carrying props 213 are mounted pivotally to the front end portion of the base frame 212 at opposite sides of the same. A pair of hydraulic cylinder units 214 are mounted on the base frame 212 and are operable so as to move the props 213 between two positions. Particularly, each of the cylinder units 214 has a piston shaft 215 with one end coupled pivotally to the upper end of the respective prop 213. Thus, by extending or retracting the piston shaft 215, the respective prop 213 can be forced to pivot relative to the base frame 212.

The coupling unit 22 includes a retractable main frame 221 disposed on top of the machine base 21, and a coupler 222 mounted on a front end of the main frame 221. The main frame 221 is formed with a slide channel 223 that extends between the front and rear ends of the main frame 221 and that has the impact unit 24 movably received therein. Four guide rollers 224 are mounted on the machine base 21 and are in rolling contact with opposite longitudinal side portions of the main frame 221 to guide movement of the coupling unit 22 relative to the machine base 21.

The main frame 221 is longitudinally movable in forward and rearward directions relative to the machine base 21. The extension unit 23 is mounted on the machine base 21 and is connected to the coupling unit 22. The extension unit 23 is operable so as to move the coupling unit 22 relative to the machine base 21. In the present embodiment, the extension unit 23 includes a hydraulic cylinder device mounted securely on the machine base 21. The extension unit 23 has a piston shaft 231 connected to a cushioning device 26 on a bottom side of a rear end of the main frame 221.

Figure 3:
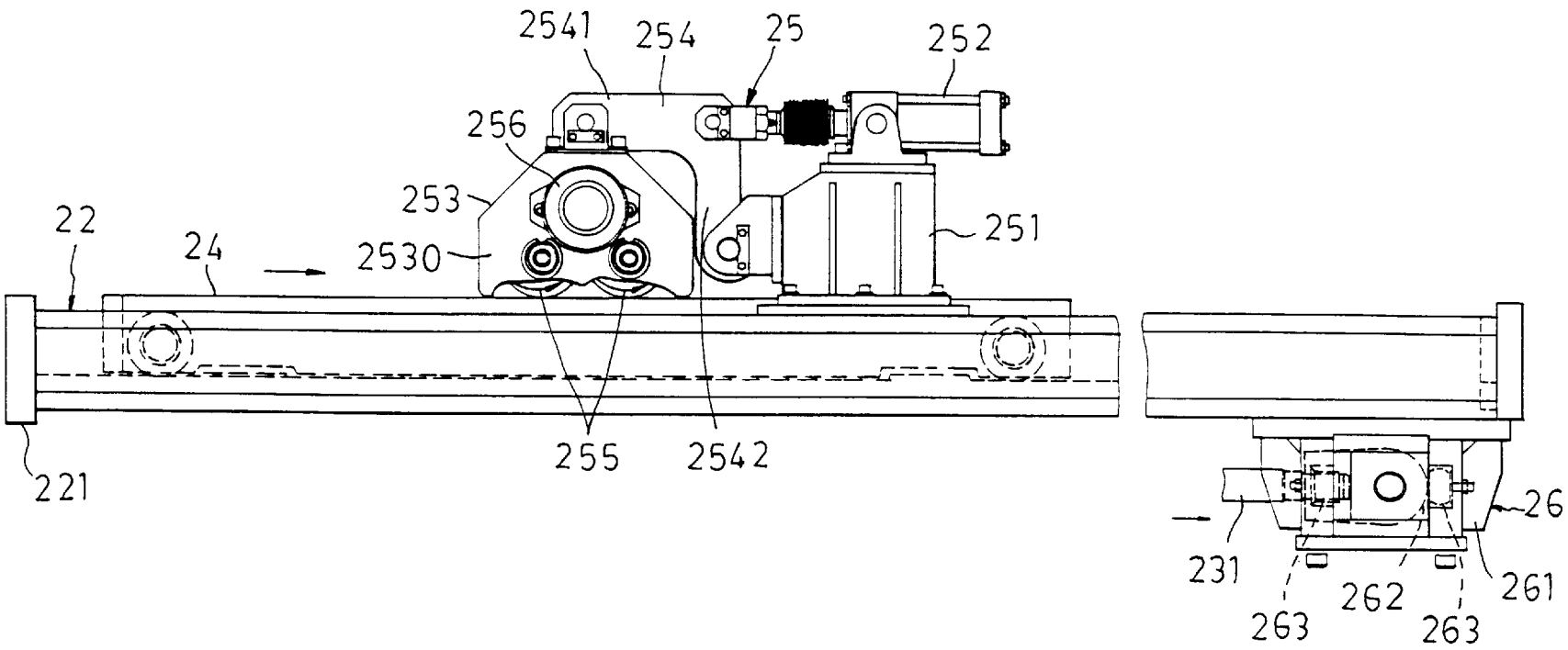
FIG. 3 is a schematic fragmentary side view illustrating a pulling operation of the preferred embodiment.
Figure 4:
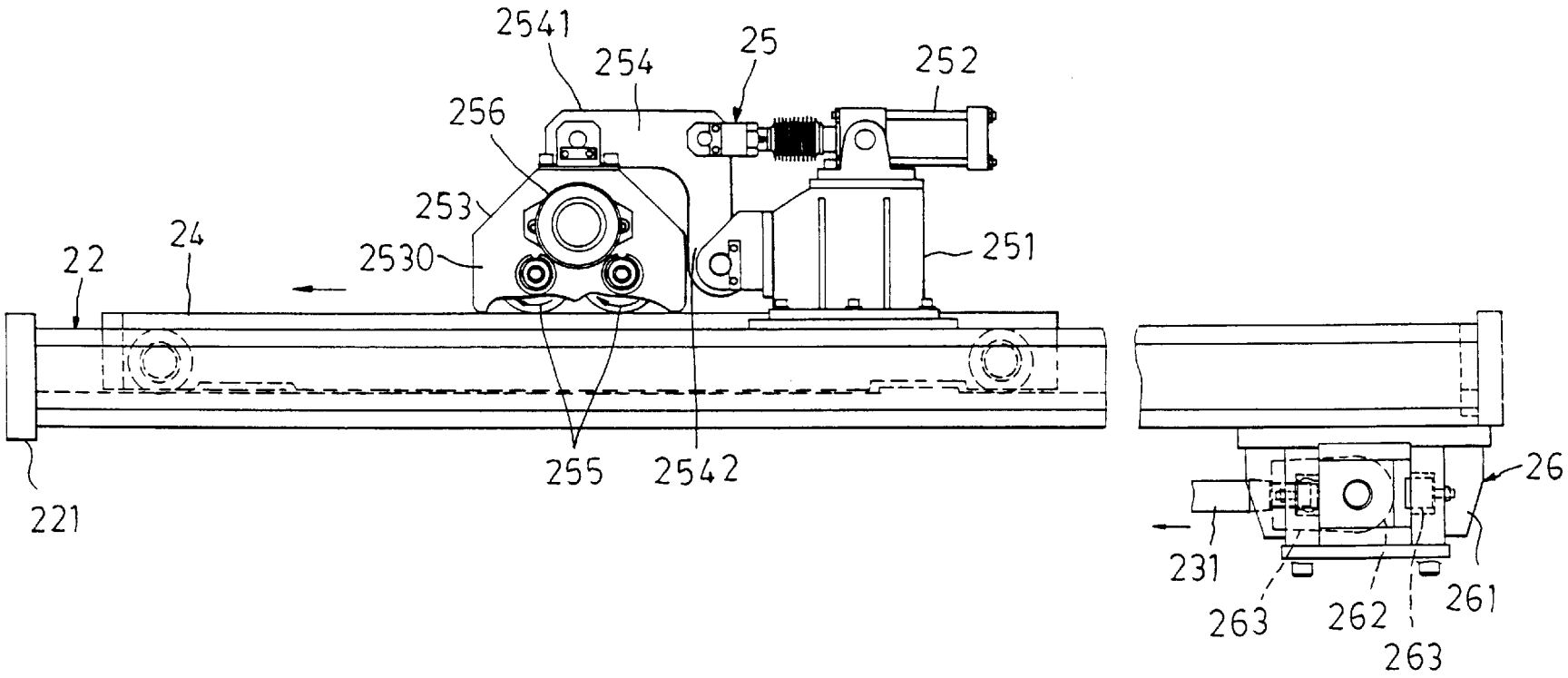
FIG. 4 is a schematic fragmentary side view illustrating a pushing operation of the preferred embodiment.

The drive unit 25 is mounted on the coupling unit 22 and is operable so as to move the impact unit 24 along the coupling unit 22 in order to enable the impact unit 24 to impact a selected one of the front and rear ends of the main frame 221 and generate one of a pushing force and a pulling force at the coupler 222. Referring to FIGS. 3 and 4, the drive unit 25 includes a base 251 mounted on the main frame 221 of the coupling unit 22, a hydraulic drive cylinder 252 mounted on the base 251, and a driver 253. The driver 253 has an L-shaped pivot arm 254 with a horizontal portion 2541 and an upright portion 2542 that extends downwardly from the horizontal portion 2541 and that is connected pivotally to the base 251 and the hydraulic drive cylinder 252. The driver 253 further has a driver housing 2530 mounted on the horizontal portion 2541 of the pivot arm 254, a plurality of friction rollers 255 mounted rotatably on the driver housing 2530 and disposed immediately above the impact unit 24, and a hydraulic motor unit 256 mounted on the driver housing 2530 and operable so as to drive rotatably the friction rollers 255. By extending or retracting the hydraulic drive cylinder 252, the pivot arm 254 pivots relative to the base 251 to cause the friction rollers 255 of the driver 253 to make or break contact with the impact unit 24. As shown in FIG. 3, when the hydraulic motor unit 256 drives the friction rollers 255 to rotate quickly in a counterclockwise direction while the friction rollers 255 are in contact with the impact unit 24, the friction force that is present between the friction rollers 255 and the impact unit 24 will result in a pushing force for pushing the impact unit 24 to move along the slide channel 223 toward the rear end of the main frame 221 of the coupling unit 22. When the impact unit 24 collides with the main frame 221 at the rear end of the slide channel 223, the coupling unit 22 is subjected to an instantaneous rearward pulling force, thereby resulting in a pulling force at the coupler 222. Accordingly, as shown in FIG. 4, when the hydraulic motor unit 256 drives the friction rollers 255 to rotate quickly in a clockwise direction while the friction rollers 255 are in contact with the impact unit 24, the friction force that is present between the friction rollers 255 and the impact unit 24 will result in a pushing force for pushing the impact unit 24 to move along the slide channel 223 toward the front end of the main frame 221 of the coupling unit 22. When the impact unit 24 collides with the main frame 221 at the front end of the slide channel 223, the coupling unit 22 is subjected to an instantaneous forward pushing force, thereby resulting in a pushing force at the coupler 222.

When the impact unit 24 is about to collide with the main frame 221 at the front or rear end of the slide channel 223, the hydraulic drive cylinder 252 can be controlled so as to retract the same, thereby causing the pivot arm 254 to pivot relative to the base 251 and lift the friction rollers 255 away from the impact unit 24. The friction rollers 255 cease to contact the top side of the impact unit 24, thereby preventing the friction rollers 255 from affecting adversely the force of impact between the impact unit 24 and the coupling unit 22. The hydraulic motor unit 256 stops rotating simultaneously. Of course, the magnitude of the impact force depends upon the moving speed of the impact unit 24 along the slide channel 223 prior to collision. After impact, the hydraulic drive cylinder 252 can be controlled so as to extend the same, thus pivoting the pivot arm 254 relative to the base 251 to force the friction rollers 255 to contact the top side of the impact unit 24, thereby preventing rebounding movement of the impact unit 24 in the slide channel 223.

The cushioning device 26 includes a casing 261 mounted on the bottom side of the rear end of the main frame 221 of the coupling unit 22, a slider 262 movably provided inside the casing 261 and coupled to one end of the piston shaft 231 of the extension unit 23 that extends into the casing 261, and a plurality of cushioning blocks 263 disposed in the casing 261 to cushion longitudinal movement of the slider 262 inside the casing 261.

Figure 5:
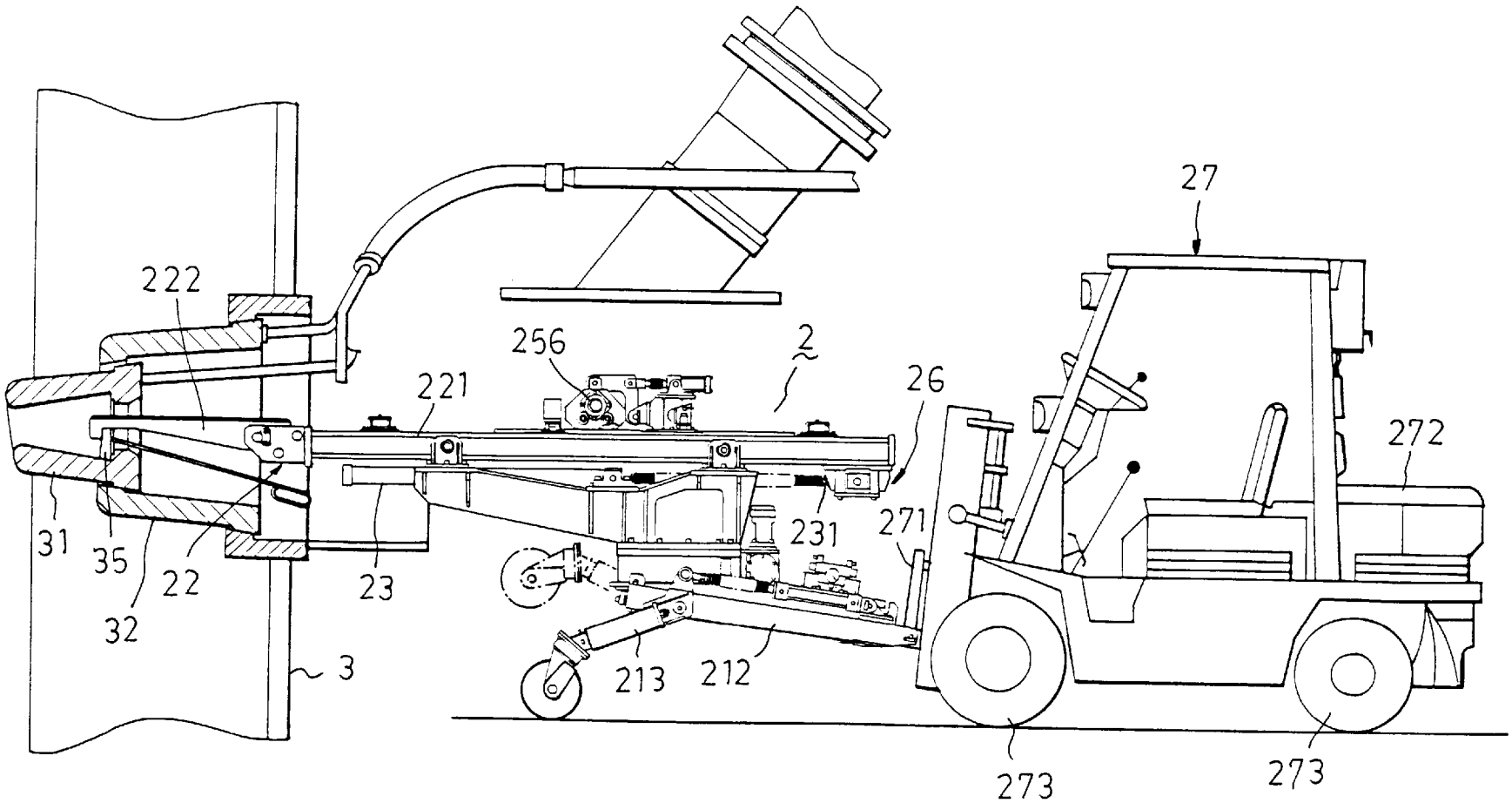
FIG. 5 is a schematic side view illustrating how the preferred embodiment is coupled to a tuyere on a furnace when disassembling the tuyere.

As shown in FIG. 5, the push-pull apparatus 2 can be used in combination with a carrier 27 to facilitate moving of the same. In this embodiment, the carrier 27 is a known power lift truck that includes a lifting frame 271, a drive source 272 for driving the truck, and wheels 273. The rear end portion of the base frame 212 of the machine base 21 is adapted to be carried on the lifting frame 271, thereby permitting raising or lowering of the push-pull apparatus 2 relative to the ground. The drive source 272 supplies the power required to operate the push-pull apparatus 2. When the wheels 273 of the carrier 27 are driven to rotate in a known manner, the push-pull apparatus 2 can be moved to a desired destination.

The push-pull apparatus 2 can be used to assemble and disassemble a tubular body that is to be fitted into a ring retainer on a wall member. In the following illustrative example, the tubular body is a tuyere 31 that is to be fitted into a copper cooling ring 32 on a surrounding wall member of a blast furnace 3. The wheel-carrying props 213 cooperate with the wheels 273 of the carrier 27 to facilitate moving of the tuyere 31, which is a relatively heavy component, from one place to another during assembly and after disassembly. Particularly, after the tuyere 31 has been pulled away from the cooling ring 32, the cylinder units 214 can be actuated to force the props 213 to pivot relative to the base frame 212 from a first position, where the props 213 are generally planar relative to the base frame 212 as shown in phantom lines, to a second position, where the props 213 are generally upright relative to the base frame 212 as shown in solid lines, thereby enabling the carrier 27 to move the push-pull apparatus 2 away from the furnace 3 in a stable manner.

Figure 6:
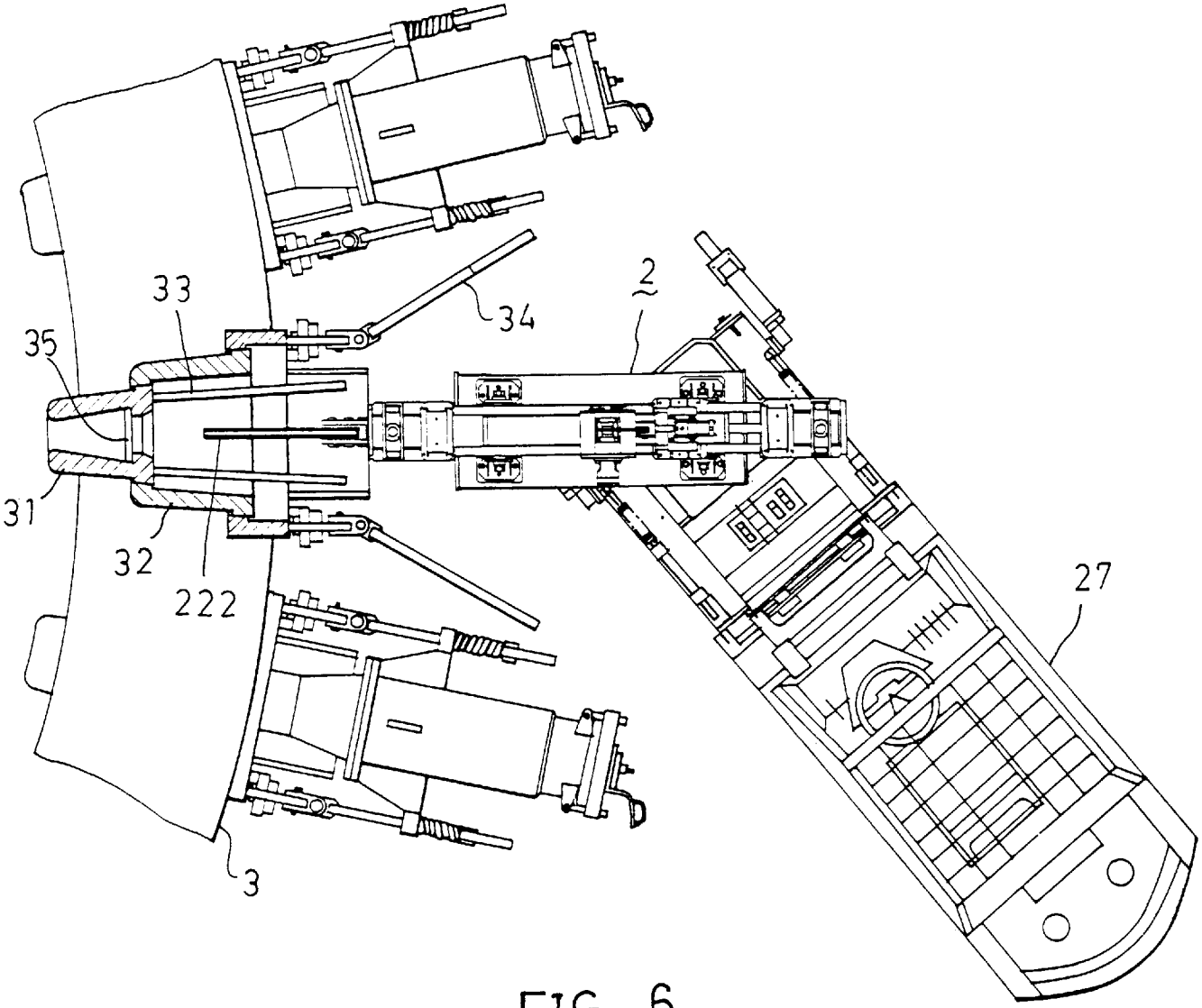
FIG. 6 is a schematic top view illustrating the preferred embodiment in a state of use.

Referring to FIG. 6, when disassembling a tuyere 31 from the furnace 3, the presence of cooling pipes 33 and mounting frames 34 at the vicinity of the furnace 3, and the limited space around the furnace 3 make it difficult to align the carrier 27 with the tuyere 31 that is to be disassembled. Under these conditions, the rotary platform 211 can be driven to rotate in a known manner so as to rotate in turn the machine base 21 relative to the base frame 212 (see FIG. 1). The coupler 222 of the coupling unit 22 can then be extended into the appropriate cooling ring 32 for engaging a force bearing plate 35 that abuts against an inner wall surface of the selected tuyere 31.

Referring once again to FIGS. 3 and 5, once the coupler 222 has been extended into the appropriate cooling ring 32, the piston shaft 231 of the extension unit 23 is extended to move the slider 262 rearwardly in the casing 261 of the cushioning device 26, thereby forcing the slider 262 to press against the cushioning blocks 263 in the rear portion of the casing 261 such that the coupling unit 22 is moved rearward longitudinally to enable the coupler 222 to hook onto the force bearing plate 35. At this time, when the hydraulic motor unit 256 drives the friction rollers 255 to rotate quickly in the counterclockwise direction while the friction rollers 255 are in contact with the impact unit 24, the impact unit 24 is pushed to move quickly along the slide channel 223 toward the rear end of the main frame 221 of the coupling unit 22. When the impact unit 24 collides with the main frame 221 at the rear end of the slide channel 223, the coupling unit 22 is subjected to an instantaneous rearward pulling force, thereby resulting in a pulling force at the coupler 222 for pulling the tuyere 31 away from the cooling ring 32. At the same time, the impact force that is generated will result in rearward movement of the casing 261, which is secured to the bottom side of the rear end of the main frame 221 of the coupling unit 22, relative to the slider 262 in the longitudinal direction, thereby causing the slider 262 to press against the cushioning blocks 263 in the front portion of the casing 261. Thus, the pulling force that is exerted by the slider 262 on the piston shaft 231 of the extension unit 23 can be reduced to protect the extension unit 23.

Figure 7:
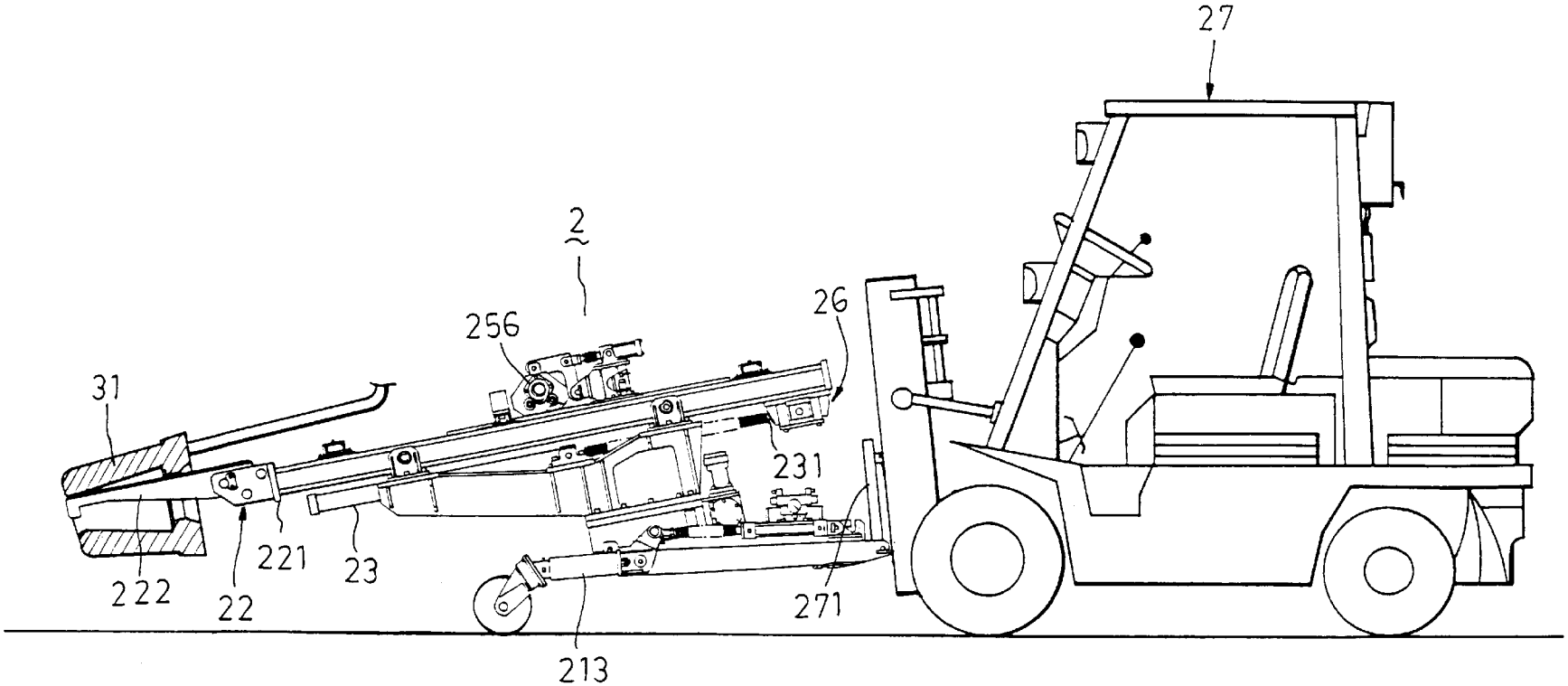
FIG. 7 is a schematic side view illustrating how the preferred embodiment is used in combination with a known carrier to move the tuyere.

Once the tuyere 31 has been disengaged from the corresponding cooling ring 32, the push-pull apparatus 2 can be raised with the use of the lifting frame 271 of the carrier 27 such that the tuyere 31 is supported on the coupler 222. The carrier 27 can then be driven to move the tuyere 31 away from the furnace 3 to the desired destination, as shown in FIG. 7. At this time, the lifting frame 271 of the carrier 27 can be operated to lower the push-pull apparatus 2, and the wheel-carrying props 213 can be operated to the first position for greater stability when moving the push-pull apparatus 2 and the tuyere 31.

Figure 8:
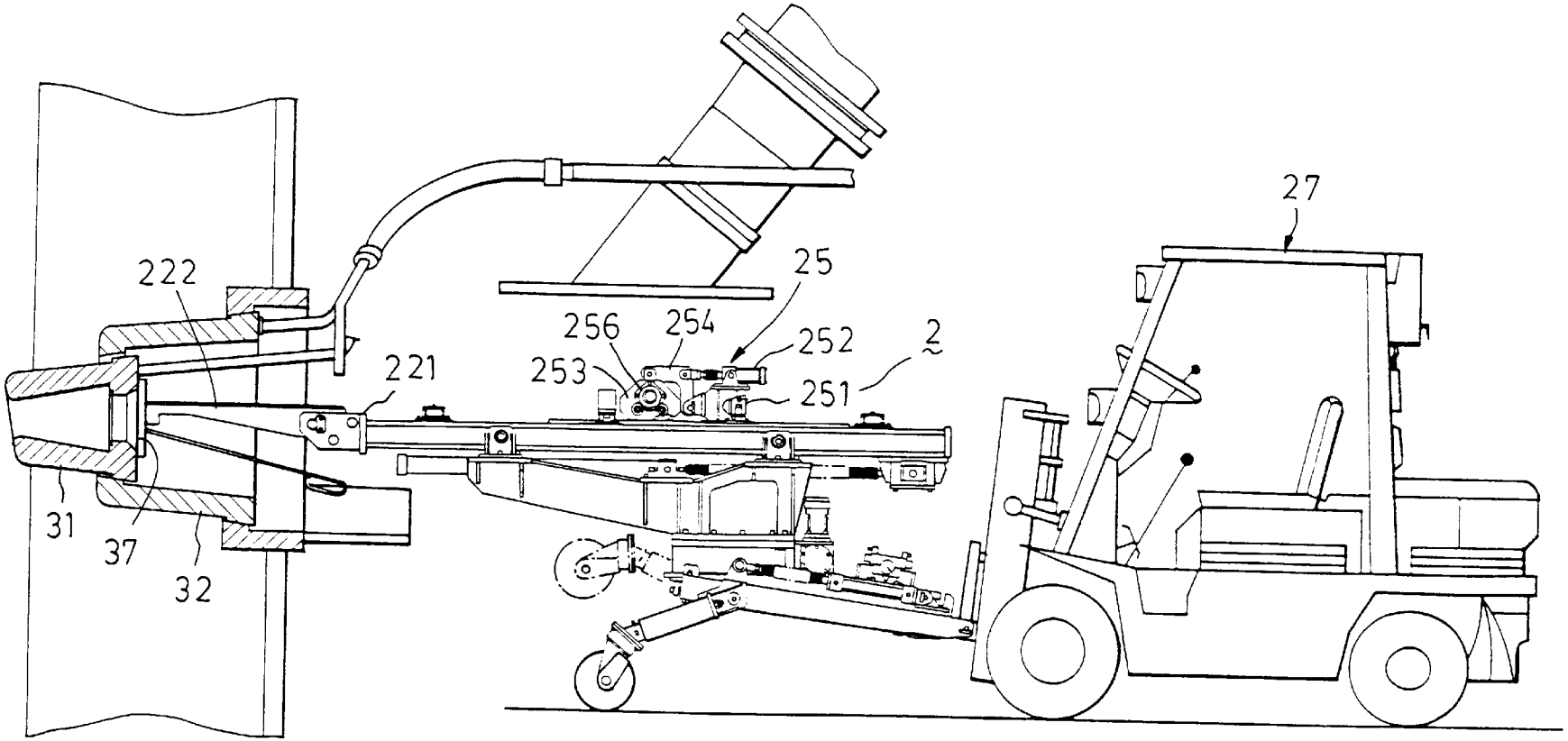
FIG. 8 is a schematic side view illustrating how the preferred embodiment is used to assemble the tuyere on the furnace.

Referring to FIGS. 4, 7 and 8, when it is desired to assemble the tuyere 31 on the furnace 3, the push-pull apparatus 2 is moved to the vicinity of the furnace 3 with the use of the carrier 27, and the coupler 222 is extended into the appropriate cooling ring 32 for abutting against a force bearing plate 37 that is provided on one end of the tuyere 31. The piston shaft 231 of the extension unit 23 is retracted to move the slider 262 forwardly in the casing 261 of the cushioning device 26, thereby forcing the slider 262 to press against the cushioning blocks 263 in the front portion of the casing 261 such that the coupling unit 22 is moved forward longitudinally to enable the coupler 222 to abut against the force bearing plate 37. At this time, when the hydraulic motor unit 256 drives the friction rollers 255 to rotate quickly in the clockwise direction while the friction rollers 255 are in contact with the impact unit 24, the impact unit 24 is pushed to move quickly along the slide channel 223 toward the front end of the main frame 221 of the coupling unit 22. When the impact unit 24 collides with the main frame 221 at the front end of the slide channel 223, the coupling unit 22 is subjected to an instantaneous forward pushing force, thereby resulting in a pushing force at the coupler 222 for pushing the tuyere 31 to engage fittingly the cooling ring 32. At the same time, the impact force that is generated will result in forward longitudinal movement of the casing 261 relative to the slider 262, thereby causing the slider 262 to press against the cushioning blocks 263 in the rear portion of the casing 261. Thus, the pushing force that is exerted by the slider 262 on the piston shaft 231 of the extension unit 23 can be reduced to protect the extension unit 23.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A push-pull apparatus adapted for assembling and disassembling a tubular body that is to be fitted into a ring retainer on a wall member, said push-pull apparatus comprising:

a machine base;

a coupling unit including a retractable main frame disposed on top of said machine base and longitudinally movable in forward and rearward directions relative to said machine base, said main frame having front and rear ends, said coupling unit further including a coupler mounted on said front end of said main frame and adapted to be extended into the ring retainer to engage the tubular body;

an extension-unit mounted on said machine base and connected to said coupling unit, said extension unit being operable so as to move said coupling unit relative to said machine base;

an impact unit provided on said coupling unit and movable along said coupling unit; and a drive unit mounted on said coupling unit and operable so as to move said impact unit along said coupling unit in order to enable said impact unit to impact a selected one of said front and rear ends of said main frame of said coupling unit and generate at said coupler of said coupling unit one of a pushing force for assembling the tubular body and a pulling force for disassembling the tubular body, wherein said main frame of said coupling unit has a rear end portion with a bottom side, said push-pull apparatus further comprising a cushioning device which is mounted on said bottom side of said rear end of said main frame and which interconnects said extension unit and said coupling unit.

2. The push-pull apparatus as claimed in claim 1, wherein said cushioning device includes a casing mounted on said main frame of said coupling unit, a slider movably provided in said casing, and a plurality of cushioning blocks disposed in said casing to cushion longitudinal movement of said slider inside said casing, said extension unit including a cylinder device with a piston shaft which has one end that extends into said casing and that is connected to said slider, said cylinder device being operable so as to move said slider inside said casing.

3. The push-pull apparatus as claimed in claim 1, further comprising:

a base frame with front and rear end portions;

a rotary platform for mounting said machine base on said base frame such that said machine base is rotatable about a vertical axis;

a pair of wheel-carrying props mounted pivotally to said front end portion of said base frame at opposite sides of said base frame, each of said wheel-carrying props having an upper end; and a pair of cylinder units mounted on said base frame, each of said cylinder units having a piston shaft with one end coupled pivotally to said upper end of a respective one of said wheel-carrying props, said piston shafts being retractable to move said wheel-carrying props from a first position, where said wheel-carrying props are generally planar relative to said base frame, and a second position, where said wheel-carrying props are generally upright relative to said base frame.

4. The push-pull apparatus as claimed in claim 1, wherein said main frame of said coupling unit is formed with a slide channel that extends between said front and rear ends of said main frame and that has said impact unit movably received therein.

5. The push-pull apparatus as claimed in claim 1, further comprising guide rollers mounted on said machine base and in rolling contact with opposite longitudinal sides of said main frame of said coupling unit to guide movement of said coupling unit relative to said machine base.

6. The push-pull apparatus as claimed in claim 1, wherein said drive unit includes:

a based mounted on said main frame of said coupling unit;

a drive cylinder mounted on said base; and a driver having an L-shaped pivot arm with a horizontal portion and an upright portion that extends downwardly from said horizontal portion and that is connected pivotally to said base and said drive cylinder, a driver housing mounted on said horizontal portion of said pivot arm, a plurality of friction rollers mounted rotatably on said driver housing and disposed immediately above said impact unit, and a motor unit mounted on said driver housing and operable so as to drive rotatably said friction rollers;

sad drive cylinder being extendable and retractable to pivot said pivot arm relative to said base and cause said friction rollers to make or break contact with said impact unit;

said friction rollers moving said impact unit along said coupling unit when said friction rollers are driven rotatably by said motor unit while said friction rollers are in contact with said impact unit.

* * * * *